United States Patent [19]

Moore

[11] Patent Number: 4,566,603

[45] Date of Patent: Jan. 28, 1986

[54] LINERLESS CLOSURE

[75] Inventor: David N. Moore, Plainfield, Ill.

[73] Assignee: Phoenix Closures, Inc., Naperville, Ill.

[21] Appl. No.: 630,002

[22] Filed: Jul. 12, 1984

[51] Int. Cl.[4] ..... B65D 53/00

[52] U.S. Cl. ..... 215/329; 215/344

[58] Field of Search ..... 215/DIG. 1, 344, 341, 215/329

[56] References Cited

U.S. PATENT DOCUMENTS

| | | | |
|---|---|---|---|
| 2,768,762 | 10/1956 | Guinet . | |
| 3,074,579 | 1/1963 | Miller | 215/344 |
| 3,215,297 | 11/1965 | Acton et al. | 215/DIG. 1 |
| 3,255,907 | 6/1966 | Eddy | 215/DIG. 1 |
| 3,463,340 | 8/1969 | Lindstrom | 215/DIG. 1 |
| 3,532,244 | 10/1970 | Yates . | |
| 3,568,871 | 3/1971 | Livingstone . | |
| 3,802,590 | 4/1974 | Culver | 215/DIG. 1 |
| 3,815,771 | 6/1974 | Marks | 215/344 |
| 3,844,439 | 10/1974 | Demers et al. | 215/344 |
| 4,143,785 | 3/1979 | Ferrell | 215/344 X |
| 4,276,989 | 7/1981 | Hicks | 215/344 X |
| 4,442,947 | 4/1984 | Banich | 215/344 |

FOREIGN PATENT DOCUMENTS

| | | | |
|---|---|---|---|
| 1782178 | 6/1978 | Fed. Rep. of Germany | 215/DIG. 1 |

*Primary Examiner*—Donald F. Norton

*Attorney, Agent, or Firm*—Welsh & Katz, Ltd.

[57] ABSTRACT

A linerless closure for use in sealing plastic bottles and jars is disclosed. The linerless closure has a series of concentric annular sealing rings for sealing contact with a bottle mouth. A ridge located between an inner and outer sealing flange provides for a minimum of two sealing surfaces and a maximum of three sealing surfaces with a bottle mouth. A buttress flange spaced inwardly of the inner sealing flange provides additional strength to the inner sealing flange for guiding an irregular bottle mouth to a sealing engagement.

9 Claims, 4 Drawing Figures

LINERLESS CLOSURE

This invention relates to closures and, in particular, to linerless closures for bottles and jars.

BACKGROUND OF THE INVENTION

Closures for use with bottles and jars in the packaging of various consumer liquids, including cosmetics, vegetable oils, vinegar, drugs and household preparations of various kinds, are generally internally threaded for mating with a similar externally threaded bottle neck or a snap or lug closure. Such closures are commonly formed of plastic or metal and may have an insert or liner on the inside of the top of the cap to form a generally fluid-tight seal against the ends of the bottles to which they are applied. Recently, linerless closures have been introduced wherein an annular flange integral with the closure projects downwardly from the inside of the top of the cap. As the closure is screwed onto the bottle, the annular flange engages against the inner wall of the bottle neck and thereby forms a tight seal with the bottle neck.

In the molding of plastic or glass bottles and jars, the precision of forming the mouth of the container in a perfect circle is somewhat lacking, thereby presenting a mouth surface on the container of considerable unevenness, both in cross-section and circular configuration. Such nonuniformities or irregularities make it difficult to obtain a proper seal on every bottle with a linerless cap. Further, with thin-walled plastic containers, there is a tendency of the container mouth walls to collapse from the torque generated in screwing the closure on.

In an effort to solve the above-noted problem, U.S. Pat. No. 3,844,439 to Demers, et al. teaches the use of an inner annular sealing ring, an intermediate compression seal, and an outer annular sealing ring whereby the inner and outer sealing flanges are deflected over the inner and outer peripheral portions of the container mouth respectively. The central compression ring or flange provides additional sealing capability while limiting further travel of the closure. However, some bottle mouths are greatly out-of-round, and the dimensional variations in the mouth of such a bottle are of such a nature and extent as can cause the container mouth to lose physical contact with the flanges or flex them to such an extent as to lose the sealing engagement between the closure and the container.

SUMMARY OF THE INVENTION

Accordingly, an object of the subject invention is a new and improved closure cap for use with plastic and glass containers.

Another object of the subject invention is an improved closure cap having additional sealing efficiency for use with containers having irregular wall thickness, out of round bottle mouths and irregular mouth land areas.

Yet another object of the subject invention is a linerless closure which may be used with plastic or glass containers having mouths substantially out-of-round while maintaining an effective seal.

These and other objects are attained by the subject invention wherein there is provided a one-piece linerless closure cap having a plurality of sealing and supporting flanges on the underside of the cap. These sealing flanges comprise a combination of inner and outer resiliently deflectable sealing flanges for engaging with and conforming to the inner and outer peripheral portions of the mouth of the plastic container with which it may be associated. A ridge or shortened flange is located on the upper cap surface between the inner and outer sealing flanges. Innermost on the underside of the cap, and spaced from the innermost flexible flange, is a relatively stiff, thick annular support flange or buttress concentric with the other flanges.

Of the flanges, the innermost two may project or angle inwardly towards the center of the closure, while the outermost flange projects or angles outwardly towards the perimeter of the closure. The intermediate ridge may extend straight downwardly from the underside of the cap. Thus, as the cap is screwed onto a bottle having a malformed, plastic bottle mouth of varying diameter such as may generally be found in the shape of an oval, the bottle mouth will at one point tend to engage the inner flexible flange at its leading edge, pushing it over to contact with the innermost buttress, where movement of the inner flexible flange will be checked. As a result, the out-of-round or oval bottle mouth will, on further rotation of the closure, be forced outwardly at that point on the inner flange to a more rounded shape until rotation of the cap can progress no more and contact is made with both the inner flange and the ridge. In this manner there will be contact with at least two surfaces for sealing engagement with both, thereby assuring a fluid-tight seal of the linerless cap on the bottle. Bottles that have mouths of generally round and regular shapes will contact both inner and outer flanges in combination with the ridge to provide a sealing action on three surfaces on the closure.

DETAILED DESCRIPTION OF THE DRAWINGS

Further objects of the invention, together with additional features contributing thereto and advantages accruing therefrom, will be apparent from the following description of one embodiment of the invention when read in conjunction with the accompanying drawings, wherein.

Figure 1:
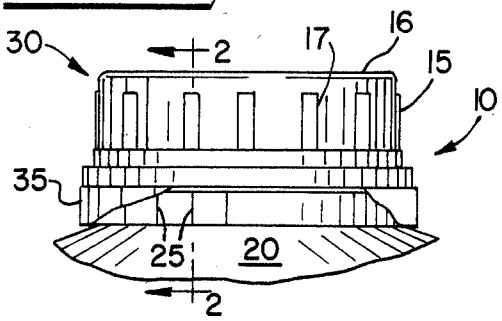
FIG. 1 is a side plan view of one embodiment of the improved linerless closure means of the subject invention, shown in place on a typical bottle mouth.

Referring now to FIG. 1, there is shown a plastic bottle and closure assembly 10 comprising a closure 30 secured to the upper part or neck 20 of a bottle. While plastic containers are shown and described herein, it should be noted that the subject invention may be used also with glass bottles, with advantages different from those experienced with plastic bottles.

Closure 30 comprises a circular upper surface 16 surrounded by a depending skirt 15 in a manner familiar to those skilled in the art. Flexibility of the closure flanges as set forth herein may be accomplished by forming such flanges integral with the closure upper surface and preferably of a plastic such as polypropylene or polyethylene. However, other polyolefins, nylons and similarly flexible materials may also be employed.

Closure 30 may have tamper-resistant means such as tamper-evident ring 35. In such an arrangement a number of triangular ratchet teeth 25 are generally fashioned on the outside surface of the bottle neck beneath the threaded portion thereof, and extending radially outwardly from the neck. In addition, a number of circumferentially spaced triangularly shaped pawls may be provided on the inside surface of the locking ring 35 to extend radially inwardly for engaging one or more of ratchet teeth 25. Thus, when cap 30 is turned in one direction, the pawls will ride over the ratchet teeth 25 on the bottle neck, and when turned in the opposite direction, the ratchet teeth will engage the pawls and break frangible connectors 36. Vertical ribbing or knurling 17 may be fashioned on the outside skirt 15 as an aid in transmitting full torque to the frangible connectors 36 on unscrewing the closure 30.

Figure 2:
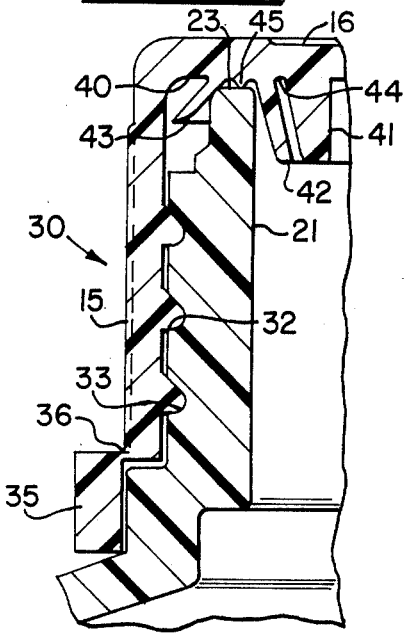
FIG. 2 is a cross-section taken along the lines 2—2 of FIG. 1 showing the sealing interface between the improved linerless closure means of the subject invention and a bottle mouth of oversized dimensions.
Figure 3:
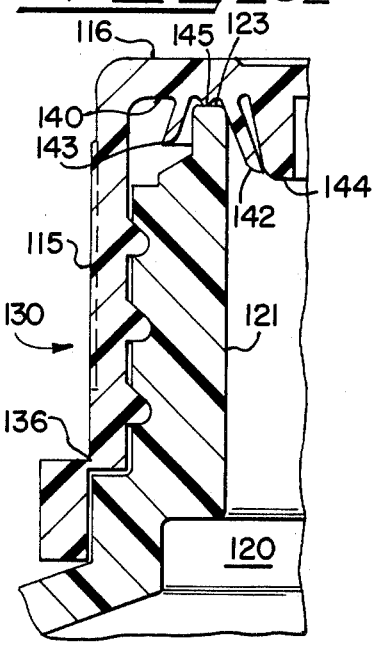
FIG. 3 is a cross-section similar to that of FIG. 2 showing an out-of-round bottle mouth of undersized dimensions making a sealing engagement with the inner sealing flange and the ridge of the linerless closure of the subject invention.
Figure 4:
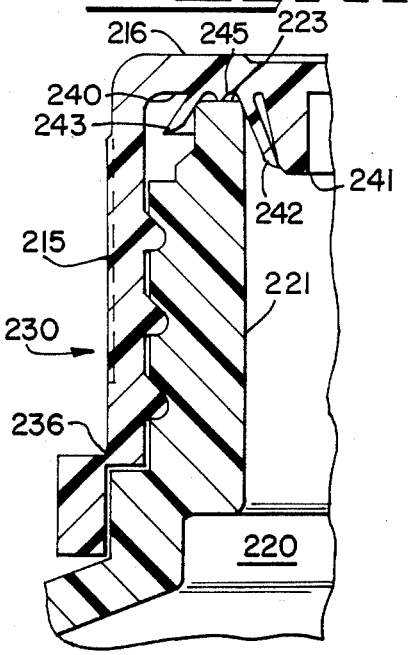
FIG. 4 is a cross-section similar to that of FIGS. 2 and 3 showing the seal developed at the interface of a closure of the subject invention and the mouth of a bottle which is generally circular.

With reference to FIGS. 2, 3 and 4, bottle 20 has a neck portion 21 having an external thread 32 formed thereon. The external thread may be either continuous, interrupted or lug. The skirt 15 of the closure cap 30 is arranged with an internal thread 33 coacting with bottle thread 32 so that turning of the closure cap 30 relative to the bottle 20, has the effect of either turning the cap into assembly with the bottle, i.e., closing the bottle, or disengaging the cap from the bottle, i.e., opening the bottle. This construction is well-known in the art. Other closure types such as snap closures may also incorporate features of the subject invention.

The closure assembly 30 of the subject invention features a unique sealing arrangement for accommodating bottle necks of plastic containers which may be out-of-round or irregular. The mouths of plastic and glass containers are known to have irregularities not only in the neck conformation, but also on the upper surface or land which defines the mouth of the container. Therefore the subject invention utilizes structure directed to providing sealing surfaces which can accommodate both types of irregularities. It should be noted that in general, the most uniform surface of a plastic bottle is the upper sealing surface or land 23, since this surface is generally cut. Therefore, most efforts to seal a particular plastic bottle should be directed to making contact with this surface.

The closure assembly 30 of the subject invention is also able to seal a bottle having much more irregularity in the mouth portion than heretofore possible. Sealing contact with the closure assembly is possible with bottle mouths of oversized diameter (FIG. 2), undersized diameter (FIG. 3) and optimum diameters (FIG. 4). In each of the situations depicted in FIGS. 2, 3 and 4, a minimum of two sealing surfaces is present at all times and, when bottle mouths are of optimum size, there are three sealing surfaces.

As stated, FIG. 2 shows the closure assembly of the subject invention used in conjunction with a bottle mouth of oversize diameter, at least at the point shown. For instance, should the bottle mouth be of an oval shape in its unencumbered or free state, then FIG. 2 would represent that portion of the interface between the closure assembly and the bottle mouth at its maximum diameter, while FIG. 3 may represent a spot on the bottle mouth 90 degrees opposite or at its minimum diameter. FIG. 4 might then represent a portion of the closure/bottle mouth interface in between the two. Thus, all three conditions, i.e., oversized, undersized, and optimum, may be present in one bottle mouth. The bottle mouth of the subject invention can effectively seal even in the simultaneous presence of all three conditions.

Referring back to FIG. 2, the closure assembly comprises skirt or side walls 15 depending from the top 16, and having tamper-resistant ring 35 secured to skirt 15 by frangible connectors 36 as stated previously. On the underside 40 of the closure is provided a series of elongated sealing rings or flanges in combination with a buttress or support flange, as will be described. Outer sealing flange 43 comprises an elongated annular ring formed to slope outwardly and to be of a relatively uniform thickness from base to apex. Spaced inwardly from the outer sealing flange is inner sealing flange 42. The inner flange is of similar size and sloping inwardly and also of a relatively uniform thickness from base to apex. The lowermost or outer end portion of flange 42 may be slightly rounded or tapered to better direct the bottle mouth outwardly upon contact. Outer flange 43 may also be rounded or radiused at its outer end to better guide the jar mouth inwardly upon contact. Between the inner sealing flange 42 and the outer sealing flange 43 and spaced from each, is ridge 45 which can comprise a generally triangular shape of substantially less height than either inner flange 42 or outer flange 43, as shown in the drawings. Ridge 45 may also be formed in a U-shape, having a radiused sealing surface.

As shown in the drawings, and stated above, ridge 45 is of substantially less height than either of inner flange 42 or outer flange 43. It should also be noted that, in the embodiment shown, inner flange 42 is of greater height than outer flange 43. Such greater height gives the advantage of accepting bottles with mouths of more irregular shape, and guiding or reshaping them for contact with ridge 45. Preferably the relative sizes of the inner sealing flange, outer sealing flange and ridge are 1.6/1.0/0.2, respectively. This ratio permits adequate strength in each flange for directing an irregular mouth wall of a plastic bottle towards ridge 45, while sufficient length is available for making the initial contact with the irregular mouth wall. To compensate for the additional length in inner sealing flange 42, which results in decreased strength at the outermost end portion of the flange, buttress 41 is provided for support of the inner flange as will be described.

In glass bottles, the cap will force the depending flanges to conform to the irregularities in the mouth wall. Thus it is necessary to make the flanges of sufficient length to permit the flange to maintain contact with the mouth walls in a continuous manner to form the required seal. With a glass bottle, the buttress flange will permit conformance of the inner flange to the wall surface while preventing the extensive deformation that would lead to a loss of sealing properties.

Inner buttress or support flange 41 is spaced inwardly of inner sealing flange 42, thereby creating a channel or furrow 44 which extends to the inner cap surface 40. Channel 44 is preferably of a width equal to or greater than the flange thickness. Buttress 41 comprises a relatively thick annular flange of generally the same height as inner flange 42. While the inner wall preferably hangs perpendicularly from the cap underside 40 and the outer wall is shown to parallel the wall of sealing flange 42, such a posture may not be necessary as long as the thickness of the buttress is sufficient to provide additional strength to the inner sealing flange and thereby to prevent any further noticeable movement of the flange inwardly beyond the contact point of the inner flange with the buttress. A thickness of the buttress approximately 60% greater than the thickness of the inner sealing flange when the inner wall hangs perpendicular from the cap underside is found preferable in preventing such inward movement of the inner sealing flange.

Each of outer sealing flange 43, ridge 45, inner sealing flange 42 and inner buttress flange 41 is circular, being concentric about a central axis (not shown) of the cap 30.

When the closure 30, formed according to the subject invention, is applied to a plastic container, that portion of the container neck being oversized, will, in the advancement of the closure towards the closed position on a bottle neck, contact outer sealing flange 43 and ridge 45 as shown in FIG. 2, deflecting outer sealing flange 43 until contact with ridge 45 is made. In the position shown in FIG. 2, sealing contact is made with two surfaces to thereby provide a fluid-tight seal of the closure on the bottle mouth 21.

Another portion of the bottle mouth, or another bottle mouth, may have a diameter which is undersized, as shown in FIG. 3. In such a case, the advancement of the closure 130 toward a closed position will cause the upper bottle mouth surface 123 to initially engage inner sealing flange 142. Further advancement of the closure towards the closed position will force inner sealing flange 142 into contact with buttress flange 141. Due to the relative thickness and immobility of buttress flange 141, inner sealing flange 42 is prevented from further movement inward. Thus, on continued advancement of the closure means over the bottle mouth, the bottle mouth 121 is pushed outwardly at that point, bringing it into a more rounded or circular configuration. The movement outward by the bottle mouth 121 continues until upper mouth surface 121 contacts ridge 145 as shown in FIG. 3, thereby completing a sealing contact at two points on upper mouth surface 123. At this point on the bottle mouth, where the undersized mouth diameter is observed, outer sealing flange 143 would not generally contact the upper mouth surface 123.

FIG. 4 depicts a sealing engagement of a closure 230 on a bottle 220 having a bottle mouth 221 of optimum diameter, at least at the point shown. In such a case, advancement of the closure 230 towards the closed position causes contact of the upper mouth surface 223 with each of outer sealing flange 243, ridge 245 and inner sealing flange 242, thereby creating a fluid-tight seal through contact with each of these three surfaces. Inner sealing flange 242 may be deflected sufficiently to contact buttress flange 241 which would then support and prevent further movement of sealing flange 242 inwardly.

The seal obtained by the combination of the sealing flanges, the ridge and the buttress flange enables closures utilizing the flange combination of the subject invention to effectively seal all plastic bottles having threaded closures and, in particular, to seal those plastic bottles which may have mouths formerly thought to be so irregular as to be incapable of forming a seal. By the action of the inner sealing flange supported by the buttress flange, practically all bottle mouths may be accommodated in this sealing arrangement regardless of the extent of the deformities in the bottle mouth.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A threaded closure cap having a skirt portion surrounding an upper portion, said upper portion having an inner surface with a series of annular depending flanges concentric about a common central axis, said depending flanges including a generally flexible outer sealing flange, a generally flexible inner sealing flange and a generally inflexible buttress means, each of said sealing flanges having generally parallel side walls; a ridge located between said inner sealing flange and said outer sealing flange and spaced from each, said buttress means being an innermost flange and spaced from said inner sealing flange to create a channel therebetween while providing a means for conforming said ridge and an upper land surface of a bottle, each of said inner sealing flange and said outer sealing flange providing sealing surfaces upon contact with a bottle mouth wall, said ridge providing a sealing surface upon contact with an upper bottle mouth surface whereby one of said inner sealing flange and said outer sealing flange makes contact with a bottle mouth wall at all times, and said ridge makes a sealing contact with said upper bottle mouth surface at all times, said buttress means providing generally inflexible support to said inner sealing flange upon contact with an irregular bottle having an undersized mouth wall portion, whereby said inner sealing flange is conformed to said bottle mouth wall configuration.

2. The closure assembly of claim 1 wherein said ridge is triangular in shape.

3. The closure assembly of claim 1 wherein said inner sealing flange has a rounded end portion for directing said bottle mouth wall outwardly.

4. The closure assembly of claim 1 wherein said buttress means comprises a flange depending from said underside surface and having a thickness of at least approximately 60% greater than that of said inner sealing flange.

5. The closure assembly of claim 1 wherein said channel is at least the same width as the thickness of said inner sealing flange.

6. The cap of claim 1 wherein said channel between said buttress flange and said inner sealing flange is of a width at least equal to the thickness of said inner sealing flange.

7. A threaded closure cap for glass and plastic containers having a skirt portion surrounding an upper portion, said upper portion having an inner surface with a series of annular depending flanges concentric about a common central axis, said depending flanges including a generally flexible outer sealing flange, a generally flexible inner sealing flange and a buttress flange, each of said sealing flanges being elongated and having generally parallel side walls; a ridge intermediate said sealing flanges and having side walls inclined toward one another and reaching an apex, said ridge being of substantially lesser size than said sealing flanges and spaced from each, said buttress flange located inwardly of said inner sealing flange and generally inflexible for support of said inner sealing flange upon contact with an out of round container mouth wall, said buttress flange being spaced from said inner sealing flange to create a channel therebetween, each of said inner sealing flange and said outer sealing flange providing sealing surfaces upon contact with a bottle mouth wall, said inner sealing flange being strengthened by said buttress flange to force a plastic bottle mouth wall to a rounder shape, and thereby conform said ridge and the land surface of a bottle mouth for sealing contact therebetween.

8. The cap of claim 7 wherein said buttress flange is of a height at least equal to that of said inner sealing flange.

9. The cap of claim 7 wherein said buttress flange is of a thickness sufficient to prevent movement of said inner sealing flange beyond contact with said buttress flange.

* * * * *